United States Patent [19]

Gaterman, III

[11] Patent Number: 4,515,346

[45] Date of Patent: May 7, 1985

[54] VALVE SPRING RETAINER ASSEMBLY

[75] Inventor: William C. Gaterman, III, Fort Lauderdale, Fla.

[73] Assignee: Crane Cams Incorporated, Hallandale, Fla.

[21] Appl. No.: 485,466

[22] Filed: Apr. 15, 1983

[51] Int. Cl.[3] ..... F01L 3/00

[52] U.S. Cl. ..... 251/337; 123/188 SB; 123/188 SC

[58] Field of Search ..... 251/337; 123/188 SB, 123/188 SC

[56] References Cited

U.S. PATENT DOCUMENTS 2,505,128 4/1950 MacPherson ..... 251/337

3,077,874 2/1963 Bush ..... 251/337

FOREIGN PATENT DOCUMENTS 536464 12/1955 Italy ..... 251/337

733326 7/1955 United Kingdom ..... 251/337

*Primary Examiner*—A. Michael Chambers

*Attorney, Agent, or Firm*—Cushman, Darby & Cushman

[57] ABSTRACT

A valve spring retainer assembly includes a valve stem for reciprocation with respect to an engine head. A valve spring retainer provides a thrust surface against which a valve spring biases the valve stem into a closed position. The retainer includes an annular lock portion for preventing extrusion of the retainer key through the valve spring retainer.

8 Claims, 5 Drawing Figures

Fig. 1.
PRIOR ART
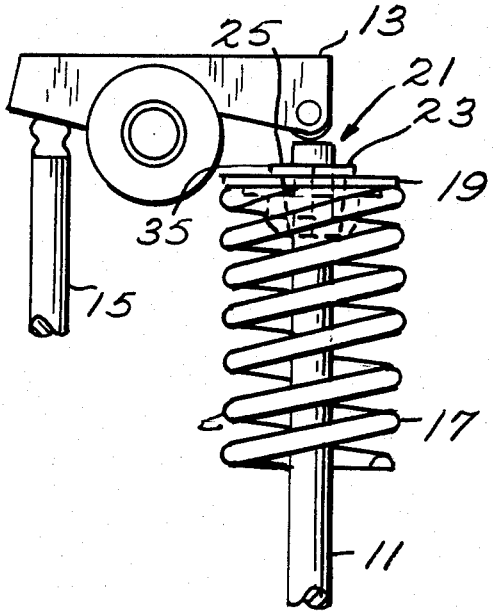
Fig. 2.
PRIOR ART
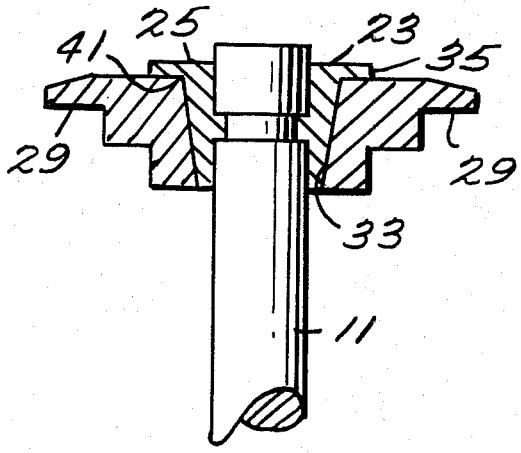
Fig. 5.
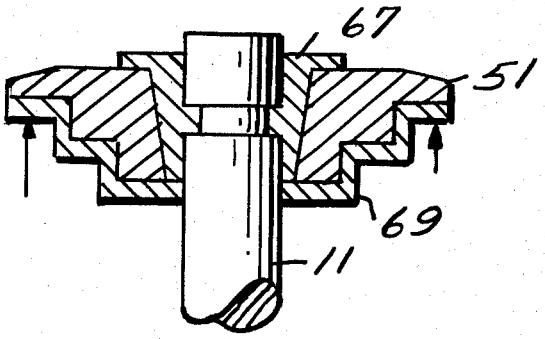
Fig. 4.
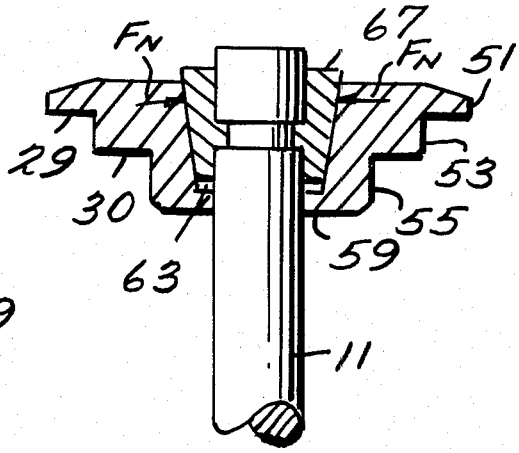
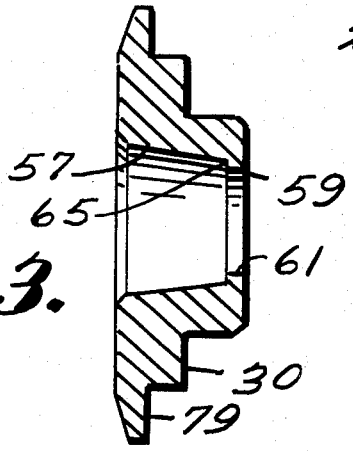
Fig. 3.

VALVE SPRING RETAINER ASSEMBLY

BACKGROUND OF THE INVENTION

The present invention relates to a valve spring retainer assembly of the type utilized in conjunction with poppet valves in internal combustion engines.

In prior art poppet valve assemblies, the valve stem is provided with one or more peripheral grooves near the tip end for receiving a valve keeper or key. Typically the key consists of a pair of mating semi-circular segments having frusto-conical outer faces and cylindrical inner faces provided with ribs for mating with the peripheral grooves in the tip end of the valve stem. The cylindrical inner faces surround the valve stem and the ribs engage the grooves in the valve stem. The conical outer face of the key provides a wedge fit with the valve spring retainer. The valve spring retainer typically has a tapered bore for mating with the frusto-conical outer surface of the key and has at least one thrust surface against which the valve spring urges the retainer upwardly against the key.

This valve spring assembly has proven to be less than adequate for high performance engines. The extreme forces exerted by the valve spring(s) on the retainer at high engine speeds often causes the keeper or key to be extruded through the valve spring retainer. The extrusion process often results in cracking and subsequently catastrophic failure of the retainer. In order to solve this problem, a flange portion has been formed integrally with the valve keeper or key, such as, disclosed in Surovek U.S. Pat. No. 3,289,658 and Tanahashi U.S. Pat. No. 4,058,091. However, as taught in the Surovek patent, the radial flange at the top portion of the split keeper directly overlies the top surface of the spring retainer such that the valve spring urges the retainer directly against the radial flange portion of the keeper. This radial flange portion has in the past been relatively thin and because of the stress concentration established where the radial flange meets the body of the keeper, such a valve retainer assembly is subject to failure at high engine operating speeds.

Others have attempted to solve the problem by forming elaborate surface geometrics between the mating surface of the keeper and the spring retainer. Thus, Newton U.S. Pat. No. Re. 24,928 discloses a value retainer assembly wherein the retainer and keeper each have a series of mating ribs and grooves for locking the retainer with respect to the keeper. More recently, Speckhart disclosed in U.S. Pat. No. 4,201,162, a smoothly tapered surface of revolution for the keeper and retainer. This of course requires close manufacturing tolerances and results in a tendency for stress concentration to occur toward the top of the keeper-retainer interface.

It therefore is an object of the present invention to provide an improved valve spring retainer assembly for use in internal combustion engines.

SHORT STATEMENT OF THE INVENTION

Accordingly, the present invention relates to a valve spring retainer assembly having a valve stem for reciprocation with respect to an engine block. A valve spring is positioned about the valve stem and between the engine block and a valve spring retainer. The valve spring retainer is located with respect to the valve stem by means of a valve keeper which has a generally fustro-conical configuration. Under normal operating conditions, the valve spring retainer is urged against the valve keeper with a wedging action. Advantageously, the valve spring retainer includes a body portion which extends below the valve keeper inwardly toward the valve stem so that under extreme operating conditions, as the valve keeper begins to extrude through the valve retainer, it abuts the inwardly extending portion of the valve retainer thereby preventing further extrusion of the valve keeper.

BRIEF DESCRIPTION OF THE DRAWINGS

Other objects, features, and advantages of the present invention will become more fully apparent for the following detailed description of the preferred embodiment, the appended claims and the accompanying drawings in which FIG. 1 is a fragmentary partial cutaway view of a prior art valve spring retainer assembly;

FIG. 2 is a section view taken in elevation of a prior art valve retainer assembly;

FIG. 3 is a section view taken in elevation of the preferred embodiment of the present invention;

FIG. 4 is a section view taken in elevation of the valve spring retainer system of the preferred embodiment of the present invention; and FIG. 5 is an alternate embodiment of the present invention shown cut away in side elevation.

DETAILED DESCRIPTION OF THE PREFERRED EMBODIMENT

Refer now to FIGS. 1 and 2 which are illustrations of a prior art valve retainer arrangement. A valve stem 11 pivotably cooperates with a rocker arm 13 for reciprocating movement with respect to an engine block (not shown). The rocker arm is pivotably connected to a push rod 15 illustrated in partial cut away. The push rod 15 cooperates with the cam shaft to rock the rocker arm 13 back and forth. A valve spring 17 bears against a valve spring retainer 19 at one end and against the engine head at the other end to urge the valve stem 11 upwardly against the rocker arm 13. The valve spring retainer is held in position with respect to the valve stem by a keeper 21 which includes a pair of retainer keys 23 and 25.

In high performance engines, such as used in racing vehicles, more than one valve spring may be used in order to increase the reaction time of the valve. The valve springs used are normally very stiff and accordingly exert substantial thrust forces on the thrust surface 29 of the valve spring retainer. Under high operating speeds the thrust forces often cause the spring valve retainer to extrude the keys 23 and 25 through the retainer.

Conventionally, the valve spring retainer has a bore 33 with an inner surface which is conical wherein the angle of generation for the cone with respect to the center line of the bore is in the range of 7 to 10 degrees. As the angle is increased, the wedging action between the keys and the retainer decreases. However, when the angle is decreased, the extreme forces exerted by the spring on the retainer causes extrusion of the keys through the valve spring retainer. There has accordingly been a need in the art for an improved valve retainer system.

As illustrated in FIGS. 1 and 2, others have attempted to form the valve retainer keys with a flange or lip portion 35. However, as the retainer keys begin to extrude through the valve spring retainer, stress concentration occurs at the junction of the flange portion 35 and the body of the key in the general vicinity of the arrow 41 illustrated in FIG. 2. Such a high stress concentration merely causes the flange or lip portion 35 to break off from the remainder of the retainer key. The level of stress concentration is increased when the flange or lip portion of the retainer key engages the valve spring retainer before a wedging action occurs between the key and the retainer.

Applicant has discovered that if a good wedging action is desired, some extrusion of the retainer key through the spring valve retainer is likely to occur. Accordingly, applicant has developed an improved valve spring retainer structure as illustrated in FIGS. 3–4. As illustrated in FIGS. 3–4, the improved valve spring retainer has a chamfered disc portion 51 integrally formed with an intermediate disc portion 53. The portion of the chamfered disc which extends outwardly beyond the intermediate cylindrical portion 53 forms a first annular thrust surface 29 for receiving the thrust forces of the valve spring.

Also, integrally formed with the chamfered disc portion and the intermediate cylindrical portion 53 is a cylindrical body portion 55. The portion of the intermediate cylindrical portion 53 which extends outwardly beyond the body portion 55 defines a second annular thrust surface 30 for receiving the thrust from a second valve spring if one is used.

The valve spring retainer defines a tapered key receiving bore 57 through the center line of the valve spring retainer. The bore has an inner surface which is conical with the angle between the surface of revolution of the cone and the center line of the bore being in the range of 7 to 10 degrees. It should be appreciated that angles greater than 10 degrees or less than 7 degrees may be used depending upon the material used and the application for the retainer. As aforementioned, as the angle approaches 10 degrees, the sectional strength of the valve spring retainer is reduced and a wedging action is difficult to attain. On the other hand, as the angle approaches 7 degrees, the sectional strength of the valve spring retainer assembly is increased and the wedging action substantially improves. The difficulty, however, is that as the angle approaches 7 degrees or less, the likelihood of the keeper being extruded through the retainer increases thereby resulting in an increased likelihood of a catastrophic failure of the value spring retainer mechanism. In order to overcome this problem, applicant has formed the bottom cylindrical portion 55 with an integrally formed, inwardly projecting lock portion 59 which has an annular inner surface 61 with a slightly larger diameter than that of the valve stem 11. The lock portion is relatively thick along the longitudinal direction of the valve stem so that if extrusion of the keeper should begin, it will terminate when the lower end of the keeper 63 abbuts the annular upper surface of the lock portion 59.

Because it is an inwardly projecting lock portion which prevents extrusion of the retainer key, a substantially greater shear force is required per weight of material to crack the lock portion than in the case of an outwardly extended flange portion positioned at the top of the retainer keys as illustrated in FIGS. 1 and 2. Moreover, because of the increased cross-sectional area of this lock portion, crack emanation which normally begins in the bottom portion of the valve spring retainer is prevented. As illustrated in FIG. 4, the retainer key 67 is not normally in contact with the inner annular surface 65 of the lock portion 59 of the valve spring retainer. Thus the full gripping effect of the wedging action between the retainer key and the valve spring retainer is utilized. It is this wedging action which provides most of the holding power for the valve.

It has been discovered that as the force bearing against the annular surface 29 increases, an inwardly directed force $F_n$ is directed normal to the surface of the retainer key 67. This increases the friction force resisting relative movement of the retainer key 67 and the valve spring retainer. In fact the force $F_n$ can be large enough to cause the retainer key 67 to become indented where the upper portion of the retainer engages it. However, crack emanation at the lower end of the retainer does not occur because of the substantially increased strength provided by the lock portion 59.

By appropriate testing, it can be determined for any given system and material used, the optimum distance between the bottom of the retainer key and the annular surface 65 of the locking portion of the valve spring retainer. This optimum distance should be such that the contact between the retainer key and annular surface 65 will only occur after the maximum wedging effect between the retainer key and the valve spring retainer has been generated. Accordingly, the thrust bearing capacity of the system will be the sum of the wedging forces generated between the retainer key and the valve spring retainer and the shear strength of the locking portion of the valve spring retainer. This capacity should be greater than the tensile strength of the valve 11. The shear strength of the valve spring retainer will, of course, depend upon the elasticity of the material used, the configuration thereof and the relative size of the locking portion of the retainer. Thus, the optimum spacing between the bottom of the retainer and the annular surface 65 will vary depending upon these factors.

In the preferred embodiment, steel, titanium or aluminum can be utilized as the material which forms the valve spring retainer. However, it should be appreciated that other materials such as graphite composite can be used in accordance with the invention. Because of the fail-safe nature of the valve spring retainer structure, lighter though weaker retainer materials can be used, thus increasing the maximum operating speed of the associated engine. Because of the unique structure of the retainer, the retainers can even be formed of steel by a stamping process.

Refer now to FIG. 5 which is a cutaway view of an alternate embodiment of the present invention. In FIG. 5 like numerals correspond to the same elements as illustrated in FIGS. 3 and 4. In this embodiment a circular sheet of metal is stamped into a cup-shaped jacket 69. The jacket 69 has an opening in the center thereof for receiving the valve shaft 11. The shape of the jacket conforms to the shape of lower surface of the valve spring retainer as illustrated.

When the retainer key begins to be extruded through the valve spring retainer, the cup-shaped jacket engages the retainer and prevents further extrusion of the key. It should be appreciated that the retainer key and jacket are illustrated as engaging one another. However, in keeping with the invention, the retainer key may be shortened so that it must first be extruded to a limited extent before it engages the jacket.

While the present invention has been disclosed in connection with the preferred embodiment thereof, it should be appreciated that there may be other embodiments of the invention which fall within the spirit and the scope of the invention as defined by the appended claims.

What is claimed is:

1. A valve spring retainer assembly comprising:
a valve stem for reciprocation with respect to an engine head;
a valve spring positioned about said valve stem;
a keeper fixed with respect to said valve stem and having a fustro-conical outer surface;
a retainer positioned between said keeper and said valve spring about said stem,
said retainer having at least one surface for engaging and retaining said spring, a conical inner surface for mating engagement with said keeper, and an integrally formed locking portion positioned below said keeper, said locking portion extending inwardly toward said valve stem below said keeper for preventing the extrusion of said keeper through said retainer.

2. A valve spring retainer assembly comprising:
a valve stem for reciprocation with respect to an engine head;
a valve spring positioned about said valve stem;
a keeper fixed with respect to said valve stem and having a frustro-conical surface;
a retainer positioned between said keeper and said valve spring about said stem;
said retainer having at least one surface for engaging said spring, a conical inner surface for mating engagement with said keeper, and an integrally formed inwardly projecting locking portion spaced longitudinally along said stem with respect to said keeper by an amount sufficient to permit a substantial wedging action between the keeper and the retainer before said keeper engages said locking portion, said locking portion preventing the extrusion of said keeper through said retainer.

3. A valve spring retainer assembly comprising;
a valve stem for reciprocation with respect to an engine head;
a valve spring positioned about said valve stem;
a keeper fixed with respect to said valve stem and having a frustro-conical outer surface; and
a retainer positioned between said keeper and said valve spring about said stem;
said retainer having at least one surface for engaging and retaining said spring, a conical inner surface for mating engagement with said frustro-conical outer surface of said keeper, said conical inner surface of said retainer being terminated in an inwardly projecting annular locking portion positioned below said keeper, said locking portion being normally spaced longitudinally along said stem with respect to said keeper but engaging said keeper after said conical portions of said keeper and said retainer have engaged one another in a wedging action.

4. A valve spring retainer assembly comprising:
a valve stem for reciprocation with respect to an engine head;
a valve spring positioned about said valve stem;
a keeper fixed with respect to said valve stem and having a frustro-conical outer surface;
a retainer positioned between said keeper and said valve spring about said stem,
said retainer having an opening in the center thereof comprising a frustro-conical shaped portion terminated in a cylindrical shaped portion, the cross section of said cylindrical shaped portion being smaller than the smallest cross section through said frustro-conical shaped portion of said opening, and said retainer having at least one spring engaging surface for retaining said valve spring, at least a portion of said frustro-conical shaped portion of said retainer opening normally engaging said keeper in a wedging action and said keeper being retained from extrusion through said retainer by the portion of said retainer proximate said cylindrical cross section portion of said opening.

5. A valve spring retainer assembly comprising:
a valve stem for reciprocation with respect to an engine head;
a valve spring positioned about said valve stem;
a keeper fixed with respect to said valve stem and having a frustro-conical outer surface;
a retainer positioned between said keeper and said valve spring about said stem; and
means for preventing said keeper from extruding through said retainer, said means engaging the bottom of said keeper as said keeper begins extrusion through said retainer.

6. The valve spring retainer assembly of claim 5 wherein said means for retaining said keeper comprises a stop member positioned between said retainer and said valve spring and in contact with said valve spring, said stop member having an opening through the center thereof for receiving said valve stem wherein the diameter of said opening is less than the diameter of the smallest section taken through the frustro-conical portion of said keeper, said stop member engaging said keeper as said keeper begins extrusion through said retainer.

7. A valve spring retainer assembly comprising:
a valve stem for reciprocation with respect to an engine head;
a valve spring positioned about said valve stem;
a keeper fixed with respect to said valve stem and having a frustro-conical outer surface; and
a retainer positioned between said keeper and said valve spring about said stem; said retainer having at least one surface for engaging and retaining said spring, a conical inner surface for mating engagement with said frustro-conical outer surface of said keeper, said conical inner surface of said retainer being terminated in an inwardly projecting annular locking portion positioned below said keeper and in normal engagement therewith, said locking portion being normally spaced longitudinally along said stem with respect to said keeper but engaging said keeper after said conical portions of said keeper and said retainer have engaged one another in a wedging action.

8. The valve spring retainer assembly of claim 5 wherein said means for retaining said keeper comprises a stop member positioned between said retainer and said valve spring and in normal contact with said valve spring and said keeper, said stop member having an opening through the center thereof for receiving said valve stem wherein the diameter of said opening is less than the diameter of the smallest section taken through the frustro-conical portion of said keeper, said stop member engaging said keeper as said keeper begins extrusion through said retainer.

* * * * *